US008251744B2

(12) United States Patent
Huang et al.

(10) Patent No.: US 8,251,744 B2
(45) Date of Patent: Aug. 28, 2012

(54) ELECTRICAL CONNECTOR WITH MAGNETIC MODULE

(75) Inventors: Chao-Tung Huang, Tu-Cheng (TW); Yong-Chun Xu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 108 days.

(21) Appl. No.: 12/753,116

(22) Filed: Apr. 2, 2010

(65) Prior Publication Data

US 2010/0255726 A1 Oct. 7, 2010

(51) Int. Cl.
*H01R 13/648* (2006.01)

(52) U.S. Cl. ..... 439/607.01

(58) Field of Classification Search ..... 439/607.01
See application file for complete search history.

(56) References Cited

U.S. PATENT DOCUMENTS

| | | | | |
|---|---|---|---|---|
| 5,759,067 | A * | 6/1998 | Scheer | 439/607.26 |
| 6,811,442 | B1 * | 11/2004 | Lien et al. | 439/620.07 |
| 6,835,098 | B1 * | 12/2004 | Chang | 439/620.06 |
| 7,074,083 | B2 * | 7/2006 | Hyland | 439/607.01 |
| 7,083,468 | B2 * | 8/2006 | Walker et al. | 439/607.01 |
| 7,348,862 | B1 | 3/2008 | Norte | |
| 7,808,751 | B2 | 10/2010 | Chen et al. | |
| 2003/0211782 | A1 * | 11/2003 | Esparaz et al. | 439/620 |
| 2007/0015416 | A1 * | 1/2007 | Gutierrez et al. | 439/676 |
| 2007/0040645 | A1 | 2/2007 | Sedio | |
| 2008/0233803 | A1 * | 9/2008 | Renteria et al. | 439/620.15 |

* cited by examiner

*Primary Examiner* — Briggitte R Hammond
(74) *Attorney, Agent, or Firm* — Ming Chieh Chang; Wei Te Chung; Andrew C. Cheng

(57) ABSTRACT

An electrical connector (100) to be mounted on a substrate provides signal channels between a first side and a second side. The electrical connector includes a transformer (210), a common mode filter (327) and a separated filter (328). The transformer includes a first wire (314) having two opposite ends electrically connected to said first side and a second wire (312) having two opposite ends and a center tap (313). The common mode filter includes a third wire (322) and a fourth wire (324), each of the third wire (322) and the fourth wire (324) having an end respectively electrically connected to the two opposite ends of the second wire (312). The separated filter (328) includes a fifth wire (326) separated from the common mode filter (327) and the transformer (310), the fifth wire (326) having an end electrically connected to the center tap (313) of the second wire (312). Opposite ends of the third, the fourth and the fifth wires (322, 324, 326) are electrically connected to the second side.

5 Claims, 4 Drawing Sheets

ELECTRICAL CONNECTOR WITH MAGNETIC MODULE

CROSS-REFERENCE TO RELATED APPLICATIONS

This patent application is related to the following pending U.S. patent applications assigned to the same assignee with this application: application Ser. No. 12/319,299, filed on Jan. 5, 2008, published in Document No. 2009 0176408 A1 on Jul. 9, 2009 and entitled "ELECTRICAL CONNECTOR HAVING AN IMPROVED MAGNETIC MODULE"; application Ser. No. 12/321,470, filed on Jan. 20, 2009, published in Document No. 2009 0186526A1 on Jul. 23, 2009 and entitled "ELECTRICAL CONNECTOR WITH MAGNETIC MODULE"; application Ser. No. 12/508,792, filed on Jul. 24, 2009, published in Document No. 2010 0022133A1 on Jan. 28, 2010 and entitled "ELECTRICAL CONNECTOR WITH MAGNETIC MODULE"; application Ser. No. 12/556,588, filed on Sep. 10, 2009, and entitled "ELECTRICAL CONNECTOR WITH MAGNETIC MODULE"; application Ser. No. 12/584,667, filed on Sep. 9, 2009, and entitled "ELECTRICAL CONNECTOR WITH MAGNETIC MODULE"; and application Ser. No. 12/556,589, filed on Sep. 10, 2009, and entitled "ELECTRICAL CONNECTOR WITH MAGNETIC MODULE".

BACKGROUND OF THE INVENTION

1. Field of the Invention

The present invention relates to an electrical connector, and more particularly, to an electrical connector having magnetic module for noise-filter.

2. Description of the Prior Art

Magnetic elements, including transformer and common mode filter, are often used to filter noises in high-speed communication. An electrical connector having magnetic modules with more effective noise filtering, smaller size and lower cost is always a focus of the designers of the field.

SUMMARY OF THE INVENTION

A main object of the present invention is to provide an electrical connector having transformer (parallel transformer) and common mode filter (serial transformer) which is convenient to be manufactured and assembled with lower cost.

The present invention provides an electrical connector used for a network interface. The electrical connector is used to be mounted on a substrate for providing signal channels between a first and a second side. The electrical connector comprises a transformer, a common mode filter and a separated filter. The transformer includes a first wire having two opposite ends electrically connected to said first side and a second wire having two opposite ends and a center tap. The common mode filter includes a third wire and a fourth wire, each of the third wire and the fourth wire having an end respectively electrically connected to the two opposite ends of the second wire. The separated filter includes a fifth wire separated from the common mode filter and the transformer, the fifth wire having an end electrically connected to the center tap of the second wire. The other ends of the third, the fourth and the fifth wires are electrically connected to the second side.

According to another aspect of the present invention, another electrical connector is provided. The electrical connector is adapted for an Ethernet interface between a physical side and a cable side. The electrical connector comprises a transformer, a common mode filter and a separated filter. The transformer includes a first wire having two opposite ends electrically connected to the cable side and a second wire having two opposite ends and a center tap. The common mode filter includes a third wire and a fourth wire, each of the third wire and the fourth wire having an end respectively electrically connected to the two opposite ends of the second wire. The separated filter includes a fifth wire separated from the common mode filter and the transformer, the fifth wire having an end electrically connected to the center tap of the second wire. The other ends of the third, the fourth and the fifth wires are electrically connected to the physical side.

According one aspect of the present invention, the second wire and the third wire and the fourth wire are physically separated from each other, so that the transformer and the common mode filter could be independently manufactured and conveniently assembled.

BRIEF DESCRIPTION OF THE DRAWINGS

The features of this invention, which are believed to be novel, are set fourth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
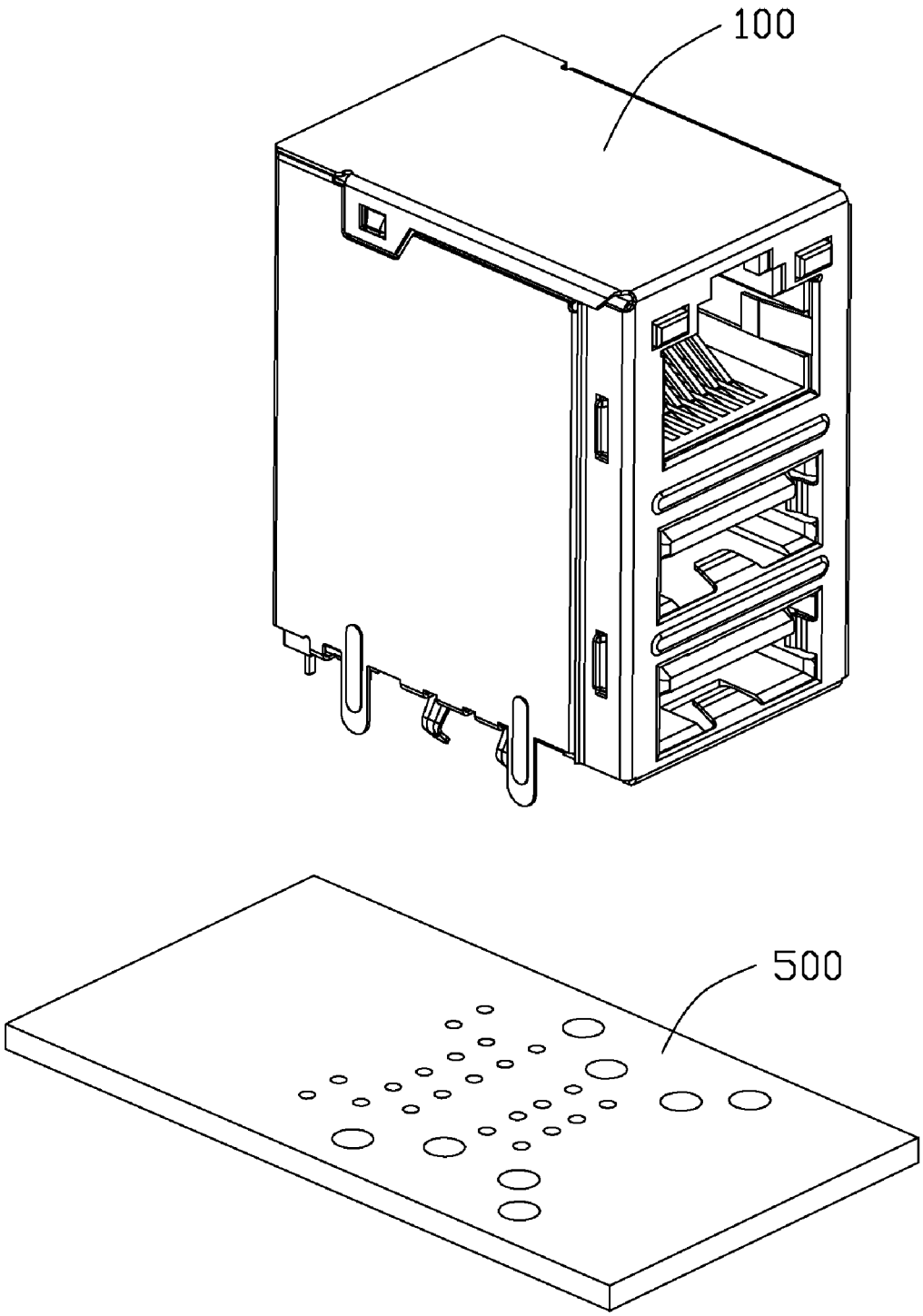
FIG. 1 is a perspective view of an electrical connector according to a first design and a printed circuit board the electrical connector mounted thereon.

Reference will now be made to the drawing figures to describe the present invention in detail.

Figure 2:
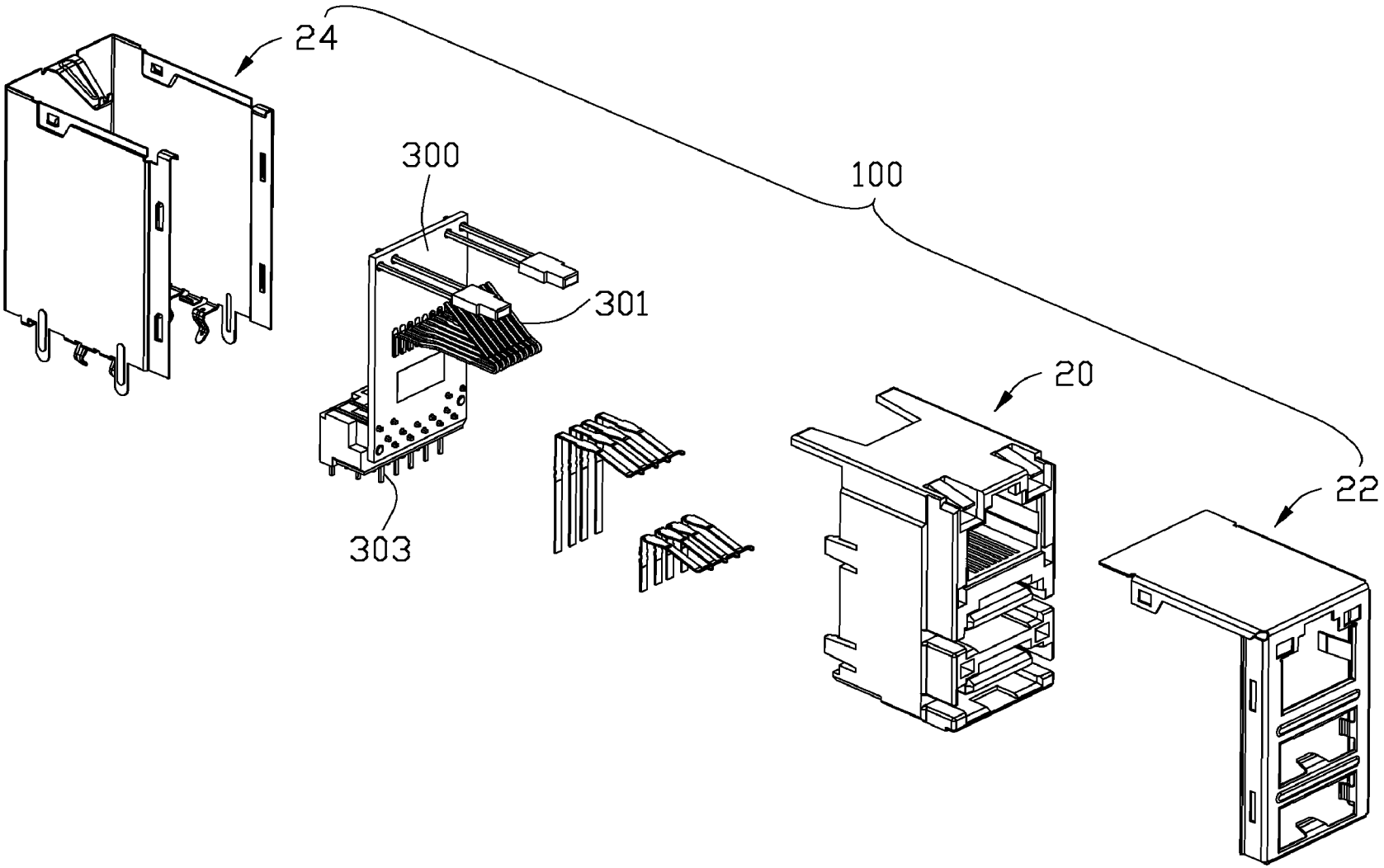
FIG. 2 is an exploded view of an electrical connector shown in FIG. 1.
Figure 3:
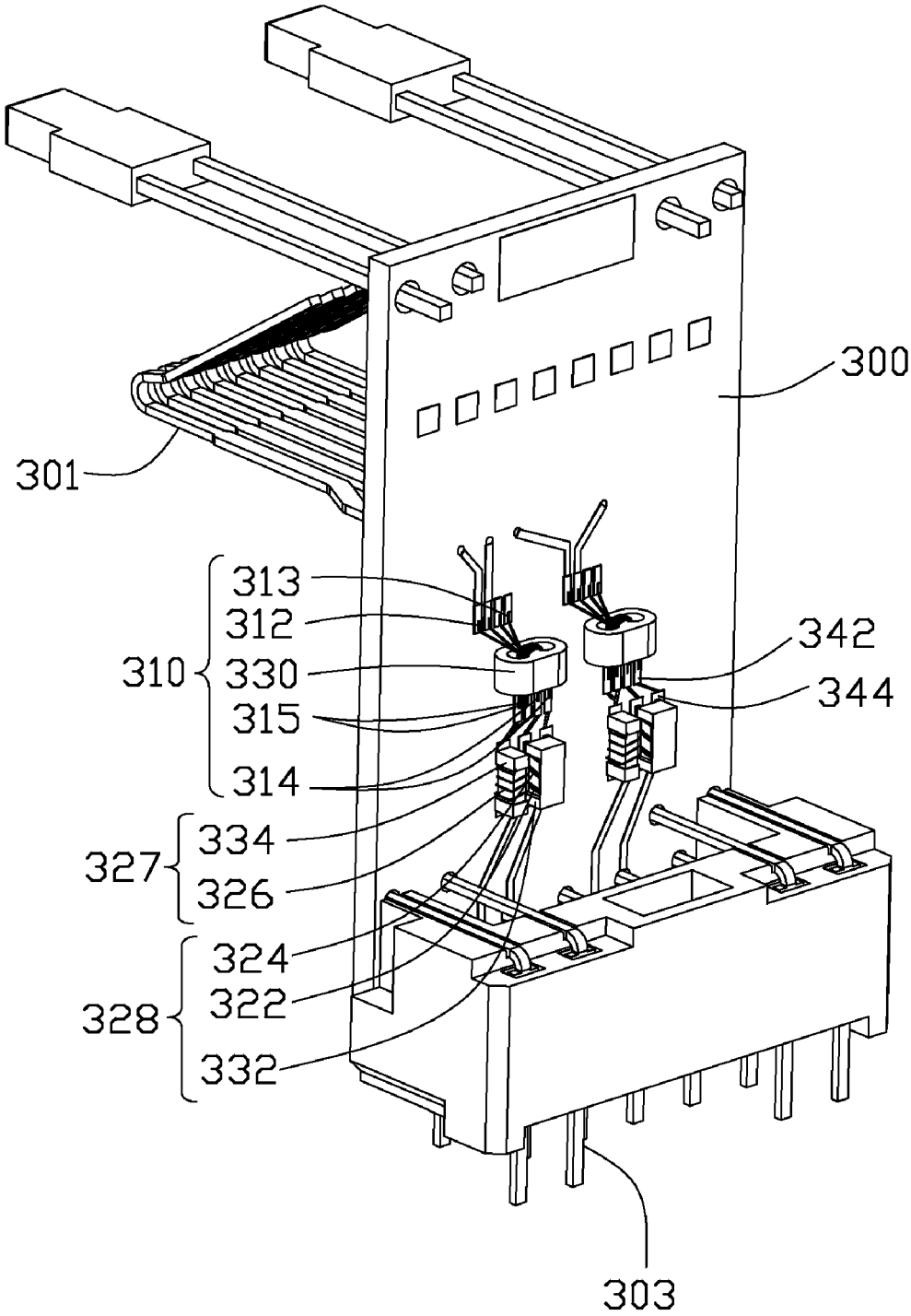
FIG. 3 is a perspective view of a contact module of an electrical connector shown in FIGS. 1 and 2.

Referring to FIGS. 1-3, an electrical connector 100 to be mounted on a substrate 500 for providing signal channels between a physical side (the side that connects to an equipment's electronic circuitry or printed circuit board) and a cable side (the side that connects to a data cable or modular plug) is shown. The electrical connector 100 comprises an insulating housing 20, a contact module received in the insulating housing 20, and an EMI shield 22, 24 covering the insulating housing 20. The contact module further comprises two transformers 310, two common mode filters 327, two separated filters 328, a plurality of mating contacts 301, a plurality of transferring contacts 303, and an interior printed circuit board (PCB) 300. Said two transformers 310, two common mode filters 327 and two separated filters 328 are mounted onto said interior PCB 300. The plurality of mating contacts 301 are mounted onto the interior PCB 300 and adapted to mate with a modular plug. The plurality of transferring contacts 303 are mounted onto the interior PCB 300 and electrically connecting to the substrate 500 when the electrical connector 100 is mounted onto the substrate 500.

Figure 4:
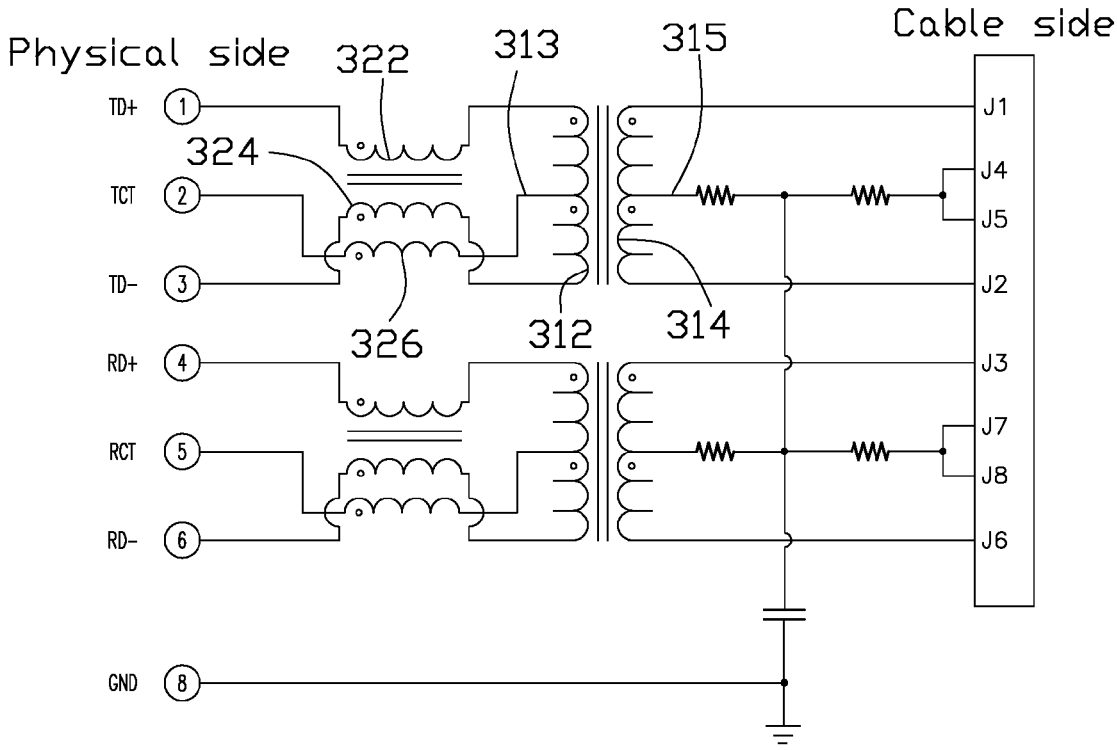
FIG. 4 is a circuit diagram of signal channels provided by the electrical connector shown in FIG. 1.

Further referring to FIG. 4, each of the transformers 310 has a first magnetic core 330, a first wire 314 and a second wire 312 winding around the first magnetic core 330. The first wire 314 has two opposite ends electrically connected to the cable side and a center tap 315 electrically connected to ground. The second wire 312 has two opposite ends and a center tap 313. The common mode filter 328 has a second magnetic core 332, a third wire 322 and a fourth wire 324 winding around the second magnetic core 332. Each of the third wire 322 and the fourth wire 324 has an end respectively electrically connected to the two opposite ends of the second wire 312 and an opposite end electrically connected to the physical side. The separated filter 327 has a third magnetic core 334 and a fifth wire 326 winding around the third magnetic core 334. The separated filter 327 is separated from the common mode filter 328 and the transformer 310. The fifth wire 326 has an end electrically connected to the center tap 313 of the second wire 312 and an opposite end connected to ground of the physical side. The interior PCB defines a plurality of conductive pads 342 and 344. The first wire 312 and the second wire 314 of the transformer 310 are directly mounted onto the conductive pads 342 of the PCB 300. The common mode filter 328 and the separated filter 327 are surface mounted onto the conductive pads 344 of the interior PCB 300.

As a preferred embodiment of the present invention, the transformers 310, the common mode filters 327 and the separated filters 328 are made of magnetic cores wound with magnetic wires 314, 312, 322, 324, 326. As a further option, the transformers 310, the common mode filter 327 and the separated filter 328 are manufactured through printed circuit technology.

In the present invention that the common mode filter 327 and the separated filter 328 are separated components decreases the complexity of the common mode filter 327 and thus reduces the cost of manufacture.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a substrate and adapted for an Ethernet interface between a physical side for connecting the substrate and a cable side for mating with a cable end connector, comprising:

a transformer including a first wire having two opposite ends electrically connected to said cable side and a second wire having two opposite ends and a center tap;

a common mode filter including a third wire and a fourth wire, each of the third wire and the fourth wire having an end respectively electrically connected to said two opposite ends of the second wire; and a separated filter including a fifth wire separated from the common mode filter and the transformer, the fifth wire having an end electrically connected to the center tap of the second wire;

wherein opposite ends of the third, the fourth and the fifth wires are electrically connected to the physical side.

2. An electrical connector according to claim 1, wherein the transformer has a first magnetic core, the common mode filter has a second magnetic core, and the separated filter has a third magnetic core.

3. An electrical connector according to claim 1, wherein the first wire has a center tap connected to ground.

4. An electrical connector according to claim 1, further comprising an interior PCB having a plurality of circuits, the transformer, the common mode filter and the separated filter being surface-mounted onto said interior PCB, the transformer being electrically connected to the common mode filter and the separated filter through the circuits of the interior PCB without any electronic component connected therebetween.

5. An electrical connector according to claim 4, further comprising a plurality of mating contacts mounted onto said interior PCB, said plurality of mating contacts being adapted to mate with a cable end connector.

* * * * *